United States Patent [19]

Herbert

[11] 3,959,698

[45] May 25, 1976

[54] SPEED CONTROL SYSTEM FOR A COILER DRIVE MOTOR

[75] Inventor: Roger B. Herbert, Amherst, N.Y.

[73] Assignee: Westinghouse Electric Corporation, Pittsburgh, Pa.

[22] Filed: Jan. 23, 1975

[21] Appl. No.: 543,377

[52] U.S. Cl. ..... 318/6; 318/332; 318/433

[51] Int. Cl.[2] ..... B59H 59/38

[58] Field of Search ..... 318/6, 332, 333, 433, 318/437, 478

[56] References Cited

UNITED STATES PATENTS

| | | | |
|---|---|---|---|
| 3,411,055 | 11/1968 | Carter et al. | 318/6 |
| 3,694,711 | 9/1972 | Bonikowski | 318/6 |
| 3,725,755 | 4/1973 | Stabile | 318/6 |
| 3,749,989 | 7/1973 | Pittner | 318/6 |
| 3,814,310 | 6/1974 | Safiuddin | 318/6 X |
| 3,910,521 | 10/1975 | O'Callaghan | 318/6 X |

*Primary Examiner*—B. Dobeck
*Attorney, Agent, or Firm*—James J. Wood

[57] ABSTRACT

A speed control system is disclosed for driving a motor at $\omega$ radians per second for the purpose of rolling material in a hollow cylindrical form with preselected outside and inside diameter OD and ID respectively. The material to be rolled is fed to the coiler at a linear speed s. An integrator having dual polarity inputs delivers an output $\omega/s$. A detector has inputs connected to receive a signal which is a function of the preselected diameters OD and ID respectively and the integrated output $\omega/s$, and an output connected to the dual polarity integrator inputs for selectively and successively activating one of the dual inputs for determining the direction of integration. A multiplier receives the integrated output and delivers multiplied products $\omega^2/s^2$ $\omega^3/s^2$, $\omega^4/s^2$. A signal shaper receives these multiplied products and delivers new products $a\omega^2/s^2$, $b\omega^3/s^2$, and $c\omega^4/s^2$ where $a$, $b$, $c$ are preselected constants. A summer sums the products $a\omega^2/s^2$, $b\omega^3/s^2$ and $c\omega^4/s^2$ and delivers the summed signal:

$$\frac{a\omega^2 + b\omega^3 + c\omega^4}{s^2}$$

to the dual inputs of the integrator. An additional multiplier receives the integration signal $\omega/s$, multiplies it by $s$, and delivers the signal $\omega$ which is the speed reference signal for the motor.

10 Claims, 3 Drawing Figures

SPEED CONTROL SYSTEM FOR A COILER DRIVE MOTOR

BACKGROUND OF THE INVENTION

The present invention relates to a control system to provide a speed reference signal to an adjustable speed drive for a laying tube type coiler. The rod, wire or strand is fed to the coiler at a substantially constant speed, while the speed of the coiler tube is alternately increased and decreased as a function of the speed reference, the rod, wire or stand emerging from the coiler being deposited in a receiving basket or carrier in spiraled ring layers.

In the past the speed reference for the coiler was obtained by using a stepping switch to selectively and successively make contact with a plurality of potentiometers, empirically adjusted, to provide a plurality of voltages for generating the periodically varying speed reference signal. The adjustment of the potentiometers is tedious and in addition, installation and maintenance are expensive.

The next step in the art was to use static components, i.e., operational amplifiers. A mathematical analysis of the problem disclosed that the speed reference should be adjusted as a function of the cube of the coiler speed and the square of the rod speed. Ideally then, if the speed were so adjusted, the rod wire or strand would nest in the basket or container in concentric rings one above the other, the symmetry only being broken by necessity when the coiler moved between the projected inside and outside diameters.

In the practical situation it has been found that the rod, or wire did not conform to the predicted classical geometry and instead resulted in irregular configurations. One such irregularity for example is the so-called beehive stacking of the coils, i.e., the outside diameter of the final coils is less than the initial coils. This condition can be prevented in some degree by manual manipulation of the speed reference for the coiler, but on the whole the results are fortuitous and depend on the skill of the operative making the adjustments.

The present invention proposes to produce more predictable and accurate results by the introduction of two additional factors which are algebraically added to the prior art coiler speed parameter to provide the speed reference signal.

SUMMARY OF THE INVENTION

A speed control system is provided for a motor driving a coiler which is rotating at a variable $\omega$ radians per second. The material is to be rolled into a hollow cylindrical form having preselected outside and inside diameters, OD and ID respectively; the material is fed to the coiler at a linear speed $s$. Means for integrating provide dual polarity inputs and deliver an output $\omega/s$. Detection means having inputs connected to receive a signal which is a function of said preselected diameters OD and ID and to receive the integrated output $\omega/s$, has its output connected to the dual inputs for selecting successively one of said dual inputs for actuation, for the purpose of determining the direction of integration of said integrating means. Multiplying means receive the integrated output $\omega/s$, and deliver the multiplied products: $\omega^2/s^2$ $\omega^3/s^2$ and $\omega^4/s^2$. Coil package shaping means are adapted to receive the said multiplied products and to deliver the products: $a\omega^2/s^2$ $b\omega^2/s^2$ and $c\omega^4/s^2$, where $a$, $b$ and $c$ are preselectable constants. Summing means receive the summed products and deliver the summed signal $$\frac{a\omega^2 + b\omega^3 + c\omega^4}{s^2},$$

to said dual inputs of said integrating means. Finally, additional multiplying means, receive the output $\omega/s$, multiply it by $s$, and deliver the speed reference signal $\omega$ to said motor.

$$\frac{y = a\omega^2 + b\omega^3 + c\omega^4}{s^2}$$

in accordance with the invention; and

Figure 3:
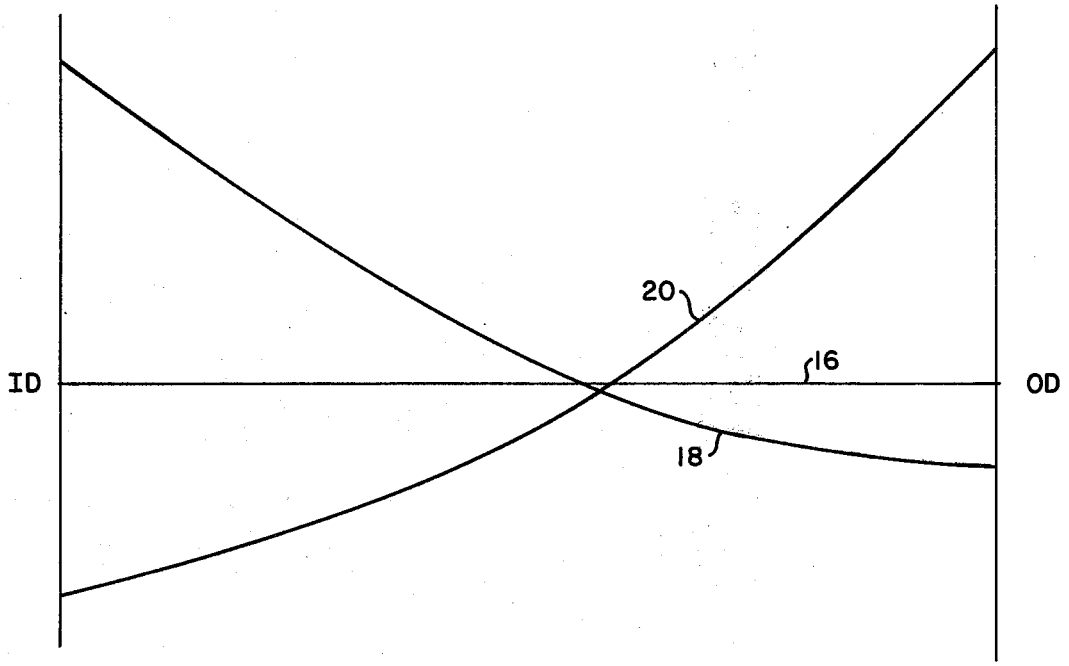

FIG. 3 is a series of curves for the idealized profiles where; $a = 1, b, c = 0$; $b = 1, a, c = 0$; $c = 1, a, b = 0$ for the function, $$\frac{y = a\omega^2 + b\omega^3 + c\omega^4}{s^2}$$

DESCRIPTION OF AN EXEMPLARY EMBODIMENT

Mathematical Considerations

In the laying tube type coiler mechanism, the material to be coiled, copper rod for example, is fed into a tube coiler at a constant speed, while the coiler is rotated at a speed which is changed in successive increments or decrements to deposit the rod in a basket or container. The tube coiler has a configuration such that the emerging rod is constrained to move in a curvilinear path which approximates the arc of a circle, the higher the speed of the coiler the smaller the diameter of the deposited copper rod, and conversely.

Assume that the rod is at the desired inside diameter D of the coil and that it is proceeding toward the larger or outside diameter.

Let:

$D$ = the coil diameter (inside)

$r$ = the coil radius (inside)

$S$ = the speed of the rod fed into the tube coiler ft/sec $\omega$ = the rotational speed of the coiler in radians/sec $\theta$ = the diameter of the copper rod $t$ = the time in seconds 1. $S = \omega r$
2. $r = D/2$
3. $S = \omega D/2$
4. $\omega = 2s/D$ or $D = 2s/\omega$ Let $\Delta D$ be an incremental change in diameter for one wrap of material $\Delta t$ = an incremental change in time for one wrap 5. $\Delta D = 2\theta$ $$\Delta t = \frac{2\pi}{\omega} \qquad (6)$$

-continued $$\frac{\Delta D}{\Delta t} = \frac{2\theta}{\frac{2\pi}{\omega}} \quad (7)$$

$$\frac{\Delta D}{\Delta t} = \frac{\theta\omega}{\pi} \quad (8)$$

$$\frac{dD}{dt} = \frac{\theta\omega}{\pi} \quad (9)$$

Differentiating (4)

$$\frac{dD}{dt} = \frac{d}{dt}\left(\frac{2s}{\omega}\right) = \frac{-2s}{\omega^2}\frac{d\omega}{dt} \quad (10)$$

Equating (9) and (10)

$$\frac{\theta\omega}{\pi} = \frac{-2s}{\omega^2}\frac{d\omega}{dt} \quad (11)$$

$$\frac{d\omega}{dt} = \frac{\frac{d\omega}{\pi}}{\frac{-2s}{\omega^2}} \quad (12)$$

$$\frac{d\omega}{dt} = \frac{-\theta\omega^3}{2\pi S} \quad (13)$$

Similarly if $D$ is the outside diameter which is decreasing, it can be shown that $$\frac{d\omega}{dt} = + \frac{\theta\omega^3}{2\pi s} \quad (14)$$

$$d\omega = \frac{\theta\omega^3}{2\pi s}dt \quad (15)$$

$$\omega = \int \frac{\theta}{2\pi}\cdot\frac{\omega^3}{s}dt \quad (16)$$

then $$\frac{\omega}{s} = \int \frac{\theta}{2\pi}\frac{\omega^3}{s^2}dt \quad (17)$$

The mathematics above suggest that in order to obtain the ideal coiler speed reference signal, an integrator should receive a voltage input a quantity which is a function of $\omega^3/s^2$. Indeed, prior art arrangements have maintained this ideal relationship, but nevertheless it has been found that the material deposited in the basket failed to conform to the intended geometric configuration — layered planar concentric rings of material.

Figure 2:
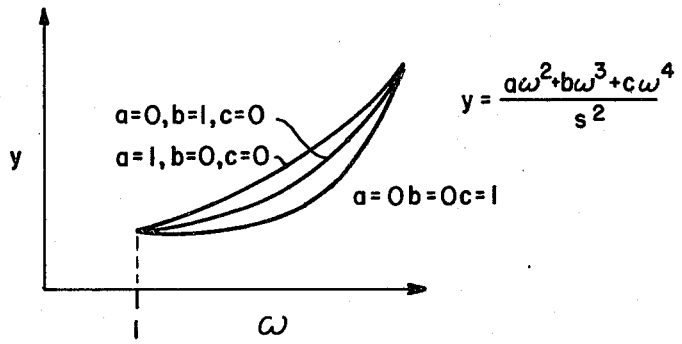
FIG. 2 is a curve of the function.

We shall refer now to FIG. 2 which depicts the input to the integrator $y$ as a function of $a$, $b$, $c$ and $\omega$. For the sake of simplicity, the coefficient of the $\omega^3$ term is replaced by a constant $b = 1$, and the term $b\omega^3$ is identified at 10. The curves 12 and 14 depict the terms $a\omega^2$ and $C\omega^4$ where $a$ and $c$ are constants $= 1$. (The choice for the constants i.e., $a$, $b$, and $c = 1$ has been deliberate in the interest of simplicity. In any practical case the constants selected can have any magnitude and may be either + or −.

The proposed input to the integrator is then:

$$f(a\omega^2 + b\omega^3 + c\omega^4)$$

In FIG. 2: curve 10, $b = 1$, $a = 0$ and $c = 0$; curve 12 $a = 1$, $b = 0$ and $c = 0$; curve 14 $c = 1$, $a = 0$ and $b = 0$.

In FIG. 3, there is shown the basket profiles for the function $y$ where:

$b = 1$(curve 16), $a = 1$(curve 18) $c = 1$ (curve 20).

As stated previously, in prior art practical arrangements the profile 16 is not flat and similarly the other profiles 18 and 20 depart from the ideal shown and produce distortions. Depending upon the material being coiled, by adjusting the input to the integrator:

$f(a\omega^2 + b\omega^3 + c\omega^4)$ a flat profile can be obtained. In one practical embodiment for rolling copper rod, the integrator input was $-0.2\omega^2 + 0.8\omega^3 - 0.2\omega^4$.

Figure 1:
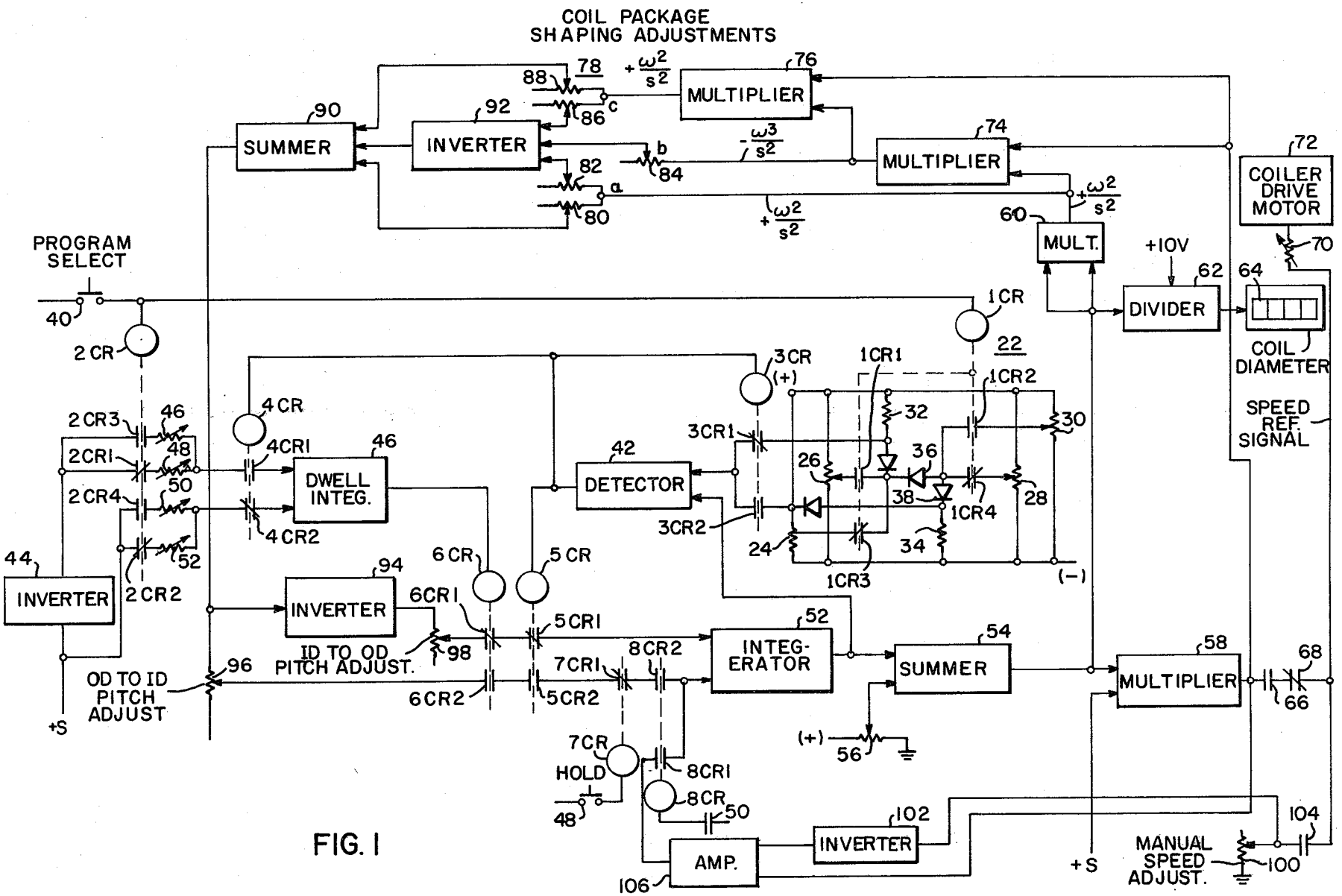
FIG. 1 is an electrical schematic of the speed control system for a coiler motor in accordance with the invention.

The coiler speed control systems of the invention is shown in FIG. 1. The maximum outside diameter (OD) and inside diameter (ID) are determined by the diameter control unit indicated generally at 22. A contact relay ICR comprises normally open contacts 1CR1, 1CR2, and normally closed contacts 1CR3, 1CR4. The maximum OD adjustments are made by adjusting potentiometer 24 or potentiometer 26; the maximum ID adjustments are made by adjusting potentiometers 28 or potentiometers 30. Completing the description of unit 22, resistors are identified at 32 and 34 and diodes at 36 and 38.

The coil 1CR is energized by the closing of switch 40 which also energizes contact relay 2CR.

The contact relay 3CR has two contacts: normally closed contact 3CR1 and normally open contact 3CR2. The output of the diameter control unit 22 is through either contacts 3CR1 or 3CR2 to a detector or summer 42. The output of the detector 42 is connected so as to electrically couple three relays: 3CR, 4CR and 5CR.

The contact relay 2CR has four contacts: normally closed 2CR1 and 2CR2 and normally open 2CR3 and 2CR4. An inverter 44 has an input connected to $+s$ signal and an output connected to 2CR3 and 2CR1. The input $+s$ is also connected directly to 2CR4 and 2CR2. Attenuation resistors are identified at 46, 48, 50 and 52 respectively.

The inverted output of 44 or the $-s$ signal is applied to a dwell integrator 46 through the contacts of relay 4CR via normally open contact 4CR1 or normally closed contact 4CR2. The output of integrator 46 controls the energization of a relay 6CR which has two contacts: normally closed 6CR1 and normally open 6CR2. Relay 5CR has normally closed contacts 5CR1 and normally open contacts 5CR2.

Two other relays are introduced at this time 7CR and 8CR. The relay 7CR has a normally closed contact 7CR1 and is energized by the closing of hold switch 48. The relay 8CR has normally closed contacts 8CR1 and normally open contacts 8CR2 and is energized by the closing of contacts 50.

The main integrator is identified at 52. The output of the integrator 52 is applied to the detector 42 and to a summer 54 which also has an input from a bias potentiometer identified at 56.

The output of summer 54 is applied to multipliers 58, 60 and to a divider 62. The multiplier 58 also receives $+s$ as an input. The output of divider 62 is to a meter 64 which gives the operator an instantaneous indication of the coil diameter. The output of the multiplier 58 is through normally open automatic contacts 66 and normally closed (manual) contacts 68, through an attenuator 70 to provide the speed control signal $\omega$ to the coiler drive motor indicated symbolically at 72.

The output of multiplier 58 is also applied to multipliers 74 and 76.

The coil package shaping adjustments are indicated generally at 78. The shaping adjustment 78 determines the magnitude of *a*, *b*, and *c* for the input to the integrator 52. The *a* adjustment is by means of potentiometers 80, 82, the *b* adjustment is by means of potentiometer 84 and lastly the *c* adjustment is by means of potentiometers 86, 88. The potentiometer connections are as follows:

The wiper of potentiometer 80 is connected to a summer 90; the wiper of potentiometer 82 is connected to an inverter 92; the wiper of potentiometer 84 is connected to inverter 92 as is the wiper of potentiometer 86; the wiper of potentiometer 88 is connected to summer 90.

The output of multiplier 60 is to multiplier 74 and to the potentiometers 80, 82. The output of multiplier 74 is to multiplier 76 and to the potentiometer 84, and finally, the output of multiplier 76 is to the potentiometers 86 and 88.

The output of summer 90 is to an inverter 94 and to an OD to ID pitch adjustment potentiometer 96. The output of inverter 94 is to an ID to OD pitch adjustment potentiometer 98.

Completing the description, a manual speed adjustment potentiometer indicated at 100 has its wiper connected through manual control contacts 104, through attenuator 70 directly to the coiler drive motor 72. The output of multiplier 58 is connected to an amplifier 106 which also receives the inverted output of an inverter 102; the inverter 102 is connected to the wiper of potentiometer 100. The output of the amplifier 106 is connected to the main integrator 52 through normally closed contacts 8CR1.

OPERATION

The operator has a choice of multiple programs, that is, he can select a coiled package product with different outside and inside diameters. For convenience the embodiment of FIG. 1 illustrates two programs:

| Max. O.D. Adjustment | Max. I.D. Adjustment |
|---|---|
| Program 1 Potentiometer 24 | Potentiometer 28 |
| Program 2 Potentiometer 26 | Potentiometer 30 |

When the program select switch 40 is open, program 1 is being utilized: relays 1CR and 2CR are deenergized and conduction is through their normally closed contacts 1CR3, 1CR4 and 2CR1, 2CR2.

The coiler speed is continuously changing such that each successive ring being laid differs in diameter from the previous ring, the magnitude of that difference being controlled by the operator's calibration of pitch adjustment potentiometers 96 (OD to ID) and 98 (ID to OD). For any given pitch setting, the amount of incremental change between successive rings will remain constant from the outermost diameter to the innermost diameter. Ideally the operator will adjust this pitch so that one increment is exactly twice the rod diameter so that the rings will nest one within another. When the laid ring diameter reaches the ID limit, the static switch (not shown) is switched which automatically changes the polarity of the pitch.

The detector 42 is a summation device which algebraically sums the two voltages at its inputs: (*a*) the voltage through contacts 3CR1 or 3CR2 and (*b*) the voltage from integrator 52. The output of the detector is binary, that is, it is ON or a ONE when the summation is + and it is OFF or a ZERO when the summation is −. When the output is ONE, relays 3CR, 4CR and 5CR are energized.

When the detector 42 picks up, the system progresses from OD to ID; conversely, when the detector 42 drops out the system progresses from ID to OD. From equation (4)$\omega = 2s/D$ it will be recalled that $D = 2s/\omega$.

Thus the smaller the diameter $D$, the higher the speed $\omega$ and conversely.

The integrator 52 swings between +10.1v and −10.1v. Assume that the integrator has reached +10.1v and that the voltage through 3CR1 is −10v. The summation is +0.1v and the output of the detector 42 is a ONE. The relays 3CR, 4CR and 5CR are energized. Contacts 6CR2 and 5CR2 are closed (the mechanism of relay 6CR will be explained later) so that a positive signal from potentiometer 96 is sent to the integrator 52, and it begins to ramp negatively. When the integrator 52 reaches −10.1v, the detector sums, −10.1v + 10.1v = −0.1v and the detector 42 output is 0: relays 3CR, 4CR and 5CR are deenergized. The deenergization of 3CR causes 3CR1 to return to its normally closed state. The −10v is applied to the detector 42 and together with the −10.1v this gives a sum of −20.1v which serves to keep the detector OFF or a ZERO.

The detector 5CR is deenergized, so contact 5CR1 is closed. There is no input to the integrator at this time since, in order to apply an input, both contacts 6CR1 and 5CR1 or 6CR2 and 5CR2 must simultaneously be in a closed condition. After a finite time determined by the dwell time, 6CR is deenergized and 6CR1 is closed. The signal from inverter 94 is applied to 98 (the ID to OD potentiometer), and a signal of opposite polarity is now applied to integrator 52 which now begins to ramp in a positive direction. The integrated output of integrator 52 moves from −10.1*v* to +10.1*v* and the output of the detector 42 is ON or a ONE. Relays 30R, CR and 5CR are again activated. Thus the coiled package now moves between OD and ID.

The dwell at both maximums OD and ID enables a few extra rings of material to be deposited. The dwell integrator 46 is arranged to saturate at +12*v* or −12*v*. When the relay 4CR is energized, −*s* is applied from inverter 44 to the dwell integrator 46; when the relay 4CR is deenergized the inverter 44 is bypassed, and +*s* is applied to the integrator 46. The +*s* and −*s* signals may be attenuated by the adjustable resistors 46, 48, 50, 52, and which attenuator the signal passes through depends upon whether or not relay 2CR is activated. The polarity of the signals +*s*, −*s* determines in which direction the output of integrator 46 will go. Thus, if the integrator is a +12*v*, the +*s* signal will cause the integrator to move toward −12*v;* conversely, when the integrator 46 is at −12*v* the −*s* signal will cause the output to go positively toward +12*v*. In each situation when the integrated output goes through zero, the relay 6CR is activated. The relay 6CR will always follow 5CR but with a time lag or dwell. The adjustment of the attenuators 46, 48, 50, 52 determines the time it takes to go from one saturation level through zero volts.

The coiler speed control system of FIG. 1 includes a manual override. When the user elects to drive the coiler motor manually, a switch or relay is activated causing contacts 68 to open and contacts 104 to close. The opening of contacts 68 disconnects the automatic system. The operator then sends a controllable speed reference signal to the drive motor 72 by manipulating the potentiometer 100.

During manual control the inverter 102 and amplifier 106 provide a corrective signal to the integrator 52 which insures that the output of integrator will seek a level equal to the signal of the manual potentiometer. Without inverter 102 and the amplifier 106, the integrator 52 might be at some voltage level which would result in a step change in coiler motor speed when the operator switched from manual to automatic.

When the operator decides to relinquish manual control and place the coiler drive motor 72 under automatic control, an automatic or so-called laid switch or relay is activated causing contacts 50 and 66 to close.

Completing the description, the integrator 52 has its output connected to summer 54 which delivers a signal $\omega/s$ which after being multiplied by multipler 58 becomes the coiler speed reference $\omega$.

The output of the summer 54 is applied as a dual input to multiplier 60 to provide its output signal: $\omega^2/s^2$ and to divider 62 which results in an output which is a function of $s/\omega$ (which itself is a function of the diameter $D$), for display on a meter 64.

The output of multiplier 60 is applied to the potentiometers 80, 82 and to multiplier 74 which also receives the signal $-\omega$ to deliver the output $$(-\omega) \times \frac{\omega^2}{s^2} = \frac{-\omega^3}{s^2}.$$

The multiplier 76 receives the signals $-\omega$ and $-\omega^3/s^2$ and performs the multiplication:

$$(-\omega)\ \frac{-\omega^3}{s^2} = \frac{+\omega^4}{s^2}$$

The potentiometer 80, 82, 86, 88 are connected to + and − sources. One potentiometer is turned all the way to zero and the other is adjusted to provide the sign and magnitude desired for $a$ and $c$; similarly, the potentiometer 84 is adjusted to provide the sign and magnitude of $b$.

The signals are inverted by inverter 92 and summed by summer 90 to provide the input to the integrator 52:

$$\frac{a\omega^2 + b\omega^3 + c\omega^4}{s^2}$$

The diameter control unit 22 provides the two sets of maximum OD and maximum ID adjustments and the dwell control unit, aided by relay 2CR and the attenuators 46, 48, 50 and 52, provides a means for adjusting the dwell time. When the operator wishes to switch from one program to another, this may be accomplished by depressing switch 40 to activate relays 1CR and 2CR.

What is claimed is:

1. A speed control system for a motor driving a coiler rotating at $\omega$ radians per second, the material to be rolled in a hollow cylindrical form having preselected outside and inside diameters, OD and ID respectively, said material being fed to the rotating coiler at a linear speed $s$, comprising:

a. means for integrating having dual polarity inputs and an output $\omega/s$;

b. means for detection having inputs connected to receive a signal which is a function of said preselected diameters OD and ID and to receive said integrated output $\omega/s$ respectively, and an output connected to said dual inputs for selecting successively one of said dual inputs for activation, for determining the direction of integration of said integrating means;

c. means for multiplying adapted to receive said integrated output $\omega/s$ and to deliver the multiplied products: $\omega^2/s^2$, $\omega^3/s^2$ and $\omega^4/s^2$;

d. means for coil package shaping adapted to receive said multiplied products and to deliver the products $a\omega^2/s^2$ $b\omega^3/s^2$ and $c\omega^4/s^2$ where $a$, $b$, and $c$ are constants;

e. means for summing for receiving said products $a\omega^2/s^2$, $b\omega^3/s^2$ and $c\omega^4/s^2$ for delivering the summed signal $$\frac{a\omega^2 + b\omega^3 + c\omega^4}{s^2}$$

to said dual inputs of said integrators; and f. additional means for receiving said output $\omega/s$ and multiplying it by $s$ to deliver the speed reference signal $\omega$ to said motor.

2. A speed control system according to claim 1 wherein said detector means comprises first and second relays connected to the output of said detection means, each relay having one normally closed and one normally open contact pair, the output of said detection means determining the state of energization of said relays, the state of closure of the contacts of said first relay determining the maximum OD and ID, and the state of closure of the contacts of said second relay determining which of said dual inputs shall be applied to said integrating means.

3. A speed control system according to claim 1 wherein said coil package shaping means comprises a plurality of potentiometers connected to d.c. potential sources respectively, the wipers of which are connected to receive said multiplied products, the position of each wiper respectively determining the sign and the magnitude of the constants $a$, $b$, and $c$.

4. A speed control system according to claim 3 wherein said coil package means includes means for receiving the potential at said wipers and for inverting the d.c. polarity thereof.

5. A speed control system according to claim 1 wherein means for dwelling are interposed in said dual polarity inputs of said integrator means to delay the time of switching from one dual input to the other.

6. A speed control system according to claim 5 wherein said dwell means comprises second integrator means having an input and an output and relay means have first normally open and second normally closed contacts, the input of said second integrator means being connected to and being actuated by the output of said detection means, said relay means being connected in the output of said second integrator means and having said first and second contacts interposed in said dual inputs respectively.

7. A speed control system according to claim 6 including means for providing a plurality of preselected d.c. voltages to the input of said second integrator means for determining the rate and direction of integration thereof.

8. A speed control system according to claim 1 including means for pitch adjustment connected to receive said summed signal to deliver OD to ID, and ID to OD pitch adjustment voltages to said dual inputs respectively.

9. A speed control system according to claim 1 including means for disconnecting the output of said integrator means from said motor; and means for providing manually adjustable speed reference signals to said motor during disconnect.

10. A speed control system according to claim 9 including means interposed between the input of said integrator means and said manually adjustable speed reference signal means for transmitting the instantaneous manually adjustable speed reference signals to the input of said integrating means, whereby the output of said integrator means follows the instantaneous manual adjustable speed reference signal.

* * * * *